US012611081B2

(12) United States Patent
Yang et al.

(10) Patent No.: US 12,611,081 B2
(45) Date of Patent: Apr. 28, 2026

(54) BASE, LAUNDRY TREATMENT DEVICE AND CLEANING SYSTEM

(71) Applicant: WUXI LITTLE SWAN ELECTRIC CO., LTD., Wuxi (CN)

(72) Inventors: Weiguo Yang, Wuxi (CN); Pengfei Ding, Wuxi (CN); Yulai Miao, Wuxi (CN); Fei Kang, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 81 days.

(21) Appl. No.: 18/685,185

(22) PCT Filed: Jun. 27, 2023

(86) PCT No.: PCT/CN2023/102797

§ 371 (c)(1),
(2) Date: Feb. 20, 2024

(87) PCT Pub. No.: WO2024/041167

PCT Pub. Date: Feb. 29, 2024

(65) Prior Publication Data

US 2025/0143530 A1 May 8, 2025

(30) Foreign Application Priority Data

Aug. 24, 2022 (CN) ..... 202211018057.5
Aug. 24, 2022 (CN) ..... 202222236081.8

(51) Int. Cl.
*A47L 11/40* (2006.01)
*D06F 39/08* (2006.01)
*D06F 39/12* (2006.01)

(52) U.S. Cl.
CPC ..... *A47L 11/4091* (2013.01); *D06F 39/088* (2013.01); *D06F 39/12* (2013.01); *A47L 2201/026* (2013.01); *A47L 2201/028* (2013.01)

(58) Field of Classification Search
CPC ..... A47L 11/4091; A47L 2201/026; A47L 2201/028; D06F 39/088; D06F 39/12
See application file for complete search history.

(56) References Cited

U.S. PATENT DOCUMENTS

2025/0057383 A1* 2/2025 Mi ..... A47L 11/4091
2025/0127366 A1* 4/2025 Li ..... A47L 11/4025
2025/0127367 A1* 4/2025 Zhou ..... A47L 11/4016

FOREIGN PATENT DOCUMENTS

CN 112294201 A 2/2021
CN 112956976 A * 6/2021 ..... A47L 11/4083
(Continued)

OTHER PUBLICATIONS

Machine translation of CN 112956976 A to Deng. (Year: 2021).*
(Continued)

*Primary Examiner* — Joseph L. Perrin
(74) *Attorney, Agent, or Firm* — Scully, Scott, Murphy & Presser, P.C.

(57) ABSTRACT

A base, a laundry treatment device and a cleaning system are provided. The base includes a pedestal and a water inlet assembly. The pedestal includes a washing portion and a robot vacuum cleaner chamber. The washing portion is configured to wash a cleaning member of a robot vacuum cleaner. The water inlet assembly includes a primary water inlet path, and a first water inlet branch in fluid communication with the primary water inlet path and/or a second water inlet branch in fluid communication with the primary water inlet path. The primary water inlet path is configured to be fluidly connected to a tap water path. The first water inlet branch is in fluid communication with the washing portion. The second water inlet branch is configured to be fluidly connected to a liquid container of the robot vacuum cleaner.

20 Claims, 9 Drawing Sheets

(56) References Cited

FOREIGN PATENT DOCUMENTS

| | | | | | |
|---|---|---|---|---|---|
| CN | 113331746 | A | * | 9/2021 | ..... A47L 11/282 |
| CN | 113440075 | A | * | 9/2021 | ..... A47L 11/4011 |
| CN | 215502793 | U | | 1/2022 | |
| CN | 215914461 | U | * | 3/2022 | |
| CN | 114521845 | A | | 5/2022 | |
| CN | 216776939 | U | | 6/2022 | |
| CN | 114855426 | A | | 8/2022 | |
| CN | 114903377 | A | * | 8/2022 | ..... D06F 39/088 |
| CN | 114908523 | A | | 8/2022 | |
| CN | 218508067 | U | | 2/2023 | |
| CN | 218508068 | U | | 2/2023 | |
| JP | 2018162622 | A | | 10/2018 | |
| RU | 2344030 | C2 | | 1/2009 | |
| RU | 104045 | U1 | | 5/2011 | |

OTHER PUBLICATIONS

Machine translation of CN 113331746 A to Liu et al. (Year: 2021).*
Machine translation of CN 113440075 A to Liu et al. (Year: 2021).*
Machine translation of CN 114903377 A to Miao et al. (Year: 2022).*
Machine translation of CN 215914461 U to Zheng et al. (Year: 2022).*
International Search Report and Written Opinion dated Oct. 9, 2023 received in International Application No. PCT/CN2023/102797.
Extended European search report dated Oct. 24, 2024 received in European Patent Application No. 23843968.1.
Office Action dated Jul. 12, 2024 received in Russian Patent Application No. 2024104307/03.
First Office Action dated Sep. 23, 2025 received in Chinese patent Application No. 202211018057.5.

* cited by examiner

BASE, LAUNDRY TREATMENT DEVICE AND CLEANING SYSTEM

CROSS-REFERENCE TO RELATED APPLICATIONS

This application is a National Stage Entry under 35 U.S.C. § 371 of PCT International Application No. PCT/CN2023/102797, filed on Jun. 27, 2023, which claims the priority of the Chinese patent application No. 202211018057.5, filed on Aug. 24, 2022, and the Chinese patent application No. 202222236081.8, filed on Aug. 24, 2022, the entire disclosures of each of which are incorporated herein by reference.

FIELD

The present disclosure relates to the field of laundry treatment technology, and in particular to a base, a laundry treatment device and a cleaning system.

BACKGROUND

Robot vacuum cleaner is configured to clean the floor. The robot vacuum cleaner is provided with a station including a water supplement tank. The water supplement tank is configured to supplement water for a liquid container (such as a clean water tank) of the robot vacuum cleaner, so that the robot vacuum cleaner can clean the floor for a long time. In the related art, the user must manually fill the water supplement tank with water.

SUMMARY

In view of this, the present disclosure is intended to provide a base, a laundry treatment device and a cleaning system that can supplement water for a clean water tank of the robot vacuum cleaner.

To achieve above object, the embodiments of the present disclosure provide a base including a pedestal and a water inlet assembly.

The pedestal includes a robot vacuum cleaner chamber and a washing portion configured to wash a cleaning member of a robot vacuum cleaner.

The water inlet assembly includes a primary water inlet path. The water inlet assembly further includes a first water inlet branch in fluid communication with the primary water inlet path, and/or a second water inlet branch in fluid communication with the primary water inlet path. The primary water inlet path is configured to be fluidly connected to a tap water path, the first water inlet branch is in fluid communication with the washing portion, and the second water inlet branch is configured to be fluidly connected to a liquid container of the robot vacuum cleaner.

In some embodiments, the water inlet assembly includes a reversing valve including a valve inlet, a first valve outlet and a second valve outlet. The primary water inlet path is in fluid communication with the valve inlet. The first water inlet branch is in fluid communication with the first valve outlet and the washing portion. The second water inlet branch is configured to fluidly connect the second valve outlet to the liquid container.

In some embodiments, the base includes a liquid storage chamber which is arranged on the primary water inlet path and located upstream of the valve inlet in a flow direction of the water in the primary water inlet path.

In some embodiments, the base includes a detergent container in fluid communication with the liquid storage chamber.

In some embodiments, the base includes an overflow path in fluid communication with the liquid storage chamber, and liquid in the liquid storage chamber is discharged to an outside or discharged into the washing portion through the overflow path responsive to a water level of the liquid storage chamber higher than a predetermined water level.

In some embodiments, the base includes a ventilation path and a first switch valve, the ventilation path fluidly connects the liquid storage chamber to the atmosphere. The first switch valve is arranged on the primary water inlet path and located between the liquid storage chamber and the valve inlet.

In some embodiments, the base includes an overflow path, a first end of the overflow path is fluidly connected to the ventilation path, and a second end of the overflow path is fluidly connected to an outside or the washing portion.

In some embodiments, the base includes a first multi-way connector. The first end of the overflow path is fluidly connected to the ventilation path through the first multi-way connector. The first multi-way connector is in the form of a multi-way joint or a multi-way valve.

In some embodiments, a highest point of the overflow path is not higher than a lowest point of the ventilation path.

In some embodiments, the water inlet assembly includes a third water inlet branch. The base includes a water discharge assembly including a water discharge path and a water discharge pump. The water discharge path fluidly connects the washing portion to the outside. The water discharge pump is arranged on the water discharge path. A first end of the third water inlet branch is configured to be fluidly connected to the tap water path, and a second end of the third water inlet branch is fluidly connected to a pipe of the water discharge path which is located between the water discharge pump and the washing portion.

In some embodiments, the water inlet assembly includes a second switch valve arranged on the third water inlet branch. The second switch valve is configured to allow or prevent the entry of tap water into the third water inlet branch.

In some embodiments, the water inlet assembly includes a second multi-way connector, and the first end of the third water inlet branch is fluidly connected to the primary water inlet path through the second multi-way connector. The second multi-way connector is in the form of a multi-way joint or a multi-way valve.

In some embodiments, the water discharge assembly includes a water storing chamber arranged on the water discharge path and located upstream of the water discharge pump in a flow direction of the water in the water discharge path. The second end of the third water inlet branch is fluidly connected to the water storing chamber.

In some embodiments, the water discharge assembly includes a third multi-way connector located upstream of the water discharge pump in a flow direction of water in the water discharge path. The second end of the third water inlet branch is fluidly connected to the water discharge path through the third multi-way connector in the form of a multi-way joint or a multi-way valve.

In some embodiments, the base includes an overflow path and a liquid storage chamber arranged on the primary water inlet path. The overflow path is in fluid communication with the liquid storage chamber. The water discharge assembly includes a fourth multi-way connector which is arranged on the water discharge path and located downstream of the water discharge pump in a flow direction of water in the water discharge path. The overflow path is in fluid communication with the water discharge path through the fourth multi-way connector in the form of a multi-way joint or a multi-way valve.

In some embodiments, the water inlet assembly includes a third switch valve arranged on the primary water inlet path. The third switch valve is configured to allow or prevent the entry of tap water into the primary water inlet path.

Another aspect of embodiments of the present disclosure provides a laundry treatment device including a laundry treatment machine and the base according to any one of above embodiments.

The laundry treatment machine includes a tub.

The pedestal is arranged below the tub.

Embodiments of the present disclosure further provide a cleaning system including a robot vacuum cleaner and the laundry treatment device described above. The robot vacuum cleaner is provided with a cleaning member and is movable into and out of the robot vacuum cleaner chamber.

At least one of the base, the washing portion and the liquid container in the embodiments of the present disclosure is supplied with tap water by the primary water inlet path. In this way, the tap water is introduced into the washing portion through the primary water inlet path and the first water inlet branch, such that water in the washing portion can wash the cleaning member of the robot vacuum cleaner, and the base can provide a function of cleaning the cleaning member, without manually washing the cleaning member by the user, which lead to a better user experience. In addition, by introducing tap water into the liquid container via the primary water inlet path and the second water inlet branch, the water supplement tank in the base for supplementing water to the liquid container can be eliminated, which not only leads to a lower cost, but also reduces a space occupied by the liquid container, and thus the base is smaller in size and lower in height. Further, since the primary water inlet path is in fluid communication with the tap water path and water is supplied to at least one of the first water inlet branch and the second water inlet branch, the modification to the tap water path of the user may be reduced, for example, the user may not have to install two tap water faucets.

DETAILED DESCRIPTION

It is to be noted that the embodiments in the present disclosure and the technical features in the embodiments can be combined with each other if no contrary, and the detailed description of the present disclosure should be interpreted as an explanation of the purpose of the present disclosure and should not be interpreted as limitation to the present disclosure.

Figure 1:
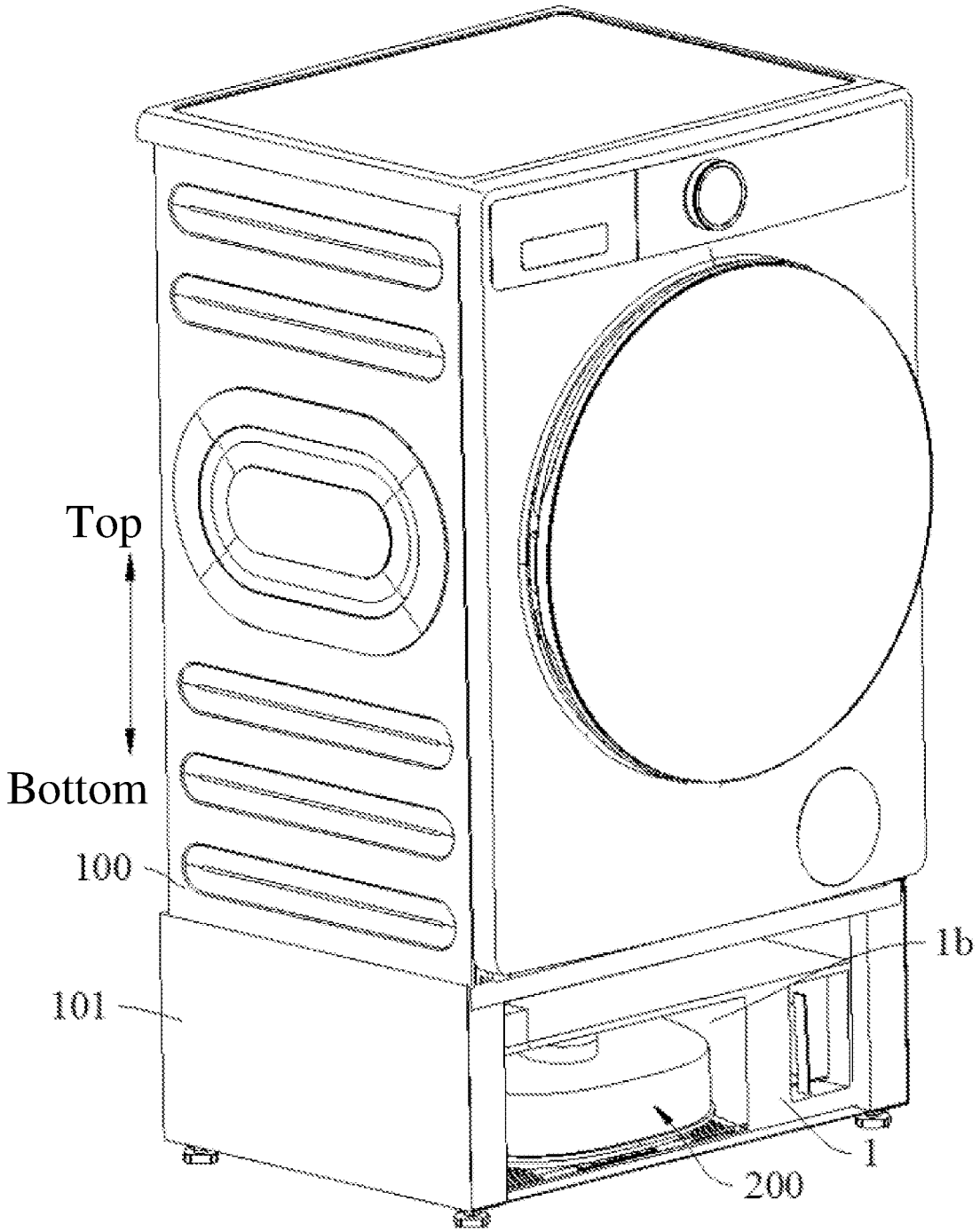
FIG. 1 is a schematic view of a cleaning system in an embodiment of the present disclosure.
Figure 2:
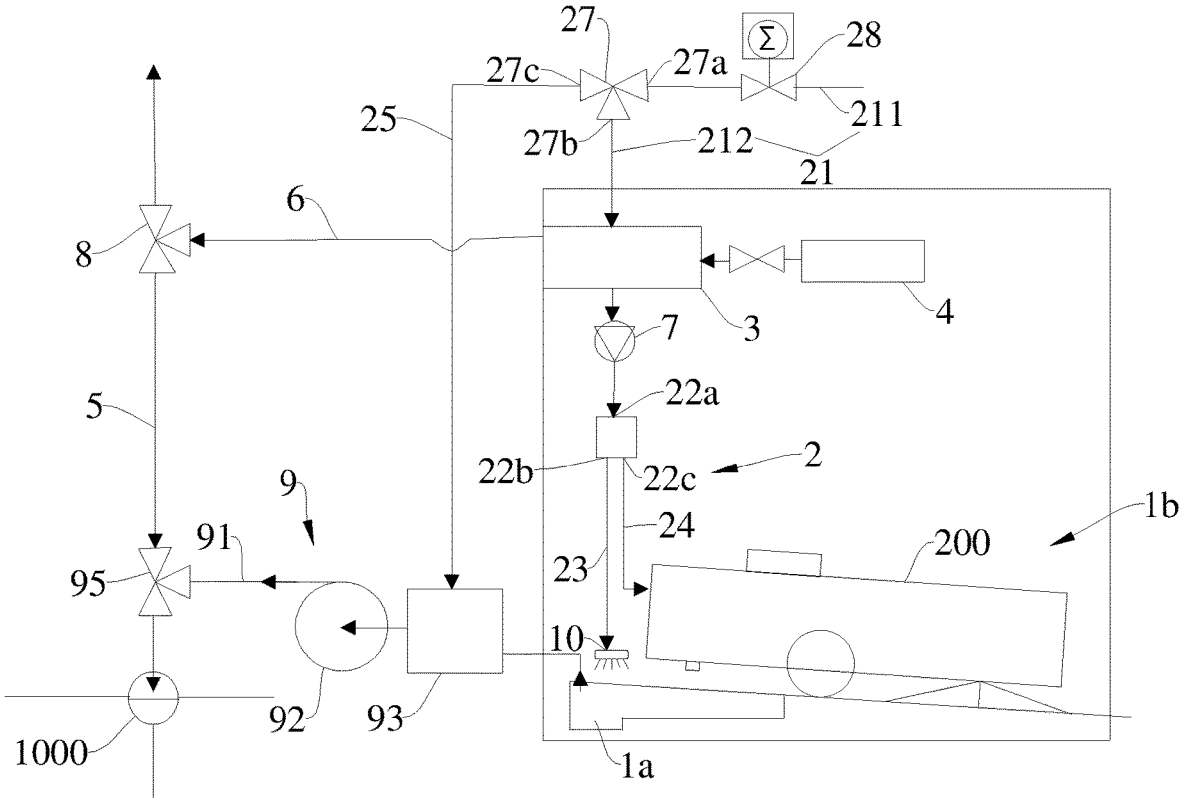
FIG. 2 is a schematic view illustrating the principle of water intake and water discharge of a first type of base in the present disclosure.

In the embodiments of the present disclosure, orientation or position relationships such as "top" and "bottom" are based on the orientation or position relationships shown in FIG. 1. It is to be understood that these orientation terms are merely for ease of describing the present disclosure and simplifying the description, and is not intended to indicate or imply that devices or elements must have specific orientations or must be configured or operated in specific orientations, and should not be understood as limiting to the present disclosure. The present disclosure is further described in detail below with reference to the drawings and specific embodiments.

With reference to FIGS. 1 to 9, embodiments of the present disclosure provide a base for a laundry treatment device.

The base includes a pedestal 1 and a water inlet assembly 2.

The pedestal 1 includes a washing portion 1*a* and a robot vacuum cleaner chamber 1*b*. The washing portion 1*a* is configured to wash a cleaning member of the robot vacuum cleaner 200. The cleaning member is configured to contact with a surface to be cleaned, such as floor, so as to clean the surface to be cleaned. The cleaning member may roll, rotate or slide relative to the floor to rub the surface to be cleaned. In this way, the cleaning member can clean the surface to be cleaned by rubbing.

As an example, the cleaning member includes but is not limited to a roller brush and/or a rag.

With reference to FIGS. 2 to 9, the water inlet assembly 2 includes a primary water inlet path 21. The water inlet assembly 2 further includes a first water inlet branch 23 in fluid communication with the primary water inlet path 21, and/or a second water inlet branch 24 in fluid communication with the primary water inlet path 21. The primary water inlet path 21 is configured to be fluidly connected to a tap water path. That is, the primary water inlet path 21 is configured to supply water to the first water inlet branch 23, and is configured to supply water to the second water inlet branch 24. The water inlet assembly 2 includes at least one of the first water inlet branch 23 and the second water inlet branch 24.

The first water inlet branch 23 is in fluid communication with a washing portion 1*a*. The second water inlet branch 24 is configured to be fluidly connected to a liquid container of the robot vacuum cleaner. In this way, the first water inlet branch 23 can supplement tap water to the washing portion 1*a*. The second water inlet branch 24 can supplement tap water to the liquid container of the robot vacuum cleaner.

The liquid container of the robot vacuum cleaner may be configured to contain clean water and/or detergent. As an example, the liquid container includes but is not limited to a clean water tank.

At least one of the base, the washing portion 1*a* and the liquid container in the embodiments of the present disclosure is supplied with tap water by the primary water inlet path 21. In this way, the tap water is introduced into the washing portion 1*a* through the primary water inlet path 21 and the first water inlet branch 23, such that water in the washing portion 1*a* can wash the cleaning member of the robot vacuum cleaner 200, and the base can provide a function of cleaning the cleaning member, without manually washing the cleaning member by the user, which lead to a better user experience. In addition, by introducing tap water into the liquid container via the primary water inlet path 21 and the second water inlet branch 24, the water supplement tank in the base for supplementing water to the liquid container can be eliminated, which not only leads to a lower cost, but also reduces a space occupied by the liquid container, and thus the base is smaller in size and lower in height. Further, since the primary water inlet path 21 is in fluid communication with the tap water path and water is supplied to at least one of the first water inlet branch 23 and the second water inlet branch 24, the modification to the tap water path of the user may be reduced, for example, the user may not have to install two tap water faucets.

In an embodiment, with reference to FIGS. 2 to 9, the water inlet assembly 2 includes the primary water inlet path 21, a reversing valve 22, the first water inlet branch 23 and the second water inlet branch 24. The reversing valve includes a valve inlet 22*a*, a first valve outlet 22*b* and a second valve outlet 22*c*. The primary water inlet path 21 is in fluid communication with the valve inlet 22*a*. The first water inlet branch 23 is in fluid communication with the first valve outlet 22*b* and the washing portion 1*a*. The second water inlet branch 24 is configured to fluidly connect the second valve outlet 22*c* to the liquid container of the robot vacuum cleaner 200. That is, the water inlet assembly 2 includes the first water inlet branch 23 and the second water inlet branch 24.

As an example, each of the primary water inlet path 21, the first water inlet branch 23 and the second water inlet branch 24 may be a conduit structure.

In the present embodiment, the reversing valve 22 may direct tap water from the primary water inlet path 21 into the washing portion 1*a* and/or the liquid container. The primary water inlet path 21 is in fluid communication with the tap water path, and the tap water is distributed through the reversing valve 22, such that changes to the tap water path of the user may be reduced, for example, the user may not have to arrange two tap water faucets. It can not only save pipes, but also realize an independent water inlet control of the first water inlet branch 23 and the second water inlet branch 24 respectively.

The reversing valve 22 is not limited to a specific type. As an example, the reversing valve 22 includes but is not limited to a solenoid valve.

With reference to FIG. 1, the laundry treatment device in the embodiment of the present disclosure includes a laundry treatment machine 100 and the base in any one of the embodiments of the present disclosure. The laundry treatment machine 100 includes a tub. The pedestal is arranged below the tub. In this way, a space below the laundry treatment machine 100 is configured to arrange the pedestal 1, so as to avoid that the pedestal 1 occupies an extra floor area, and to save spaces and provide better user experience. The pedestal 1 can further provide support for the laundry treatment machine 100.

The robot vacuum cleaner 200 can be an intelligent robot vacuum cleaner 200. That is, the robot vacuum cleaner 200 includes a control unit and a moving structure, and the control unit can control the moving structure to move autonomously and the cleaning member to work autonomously. For example, in the case where the moving structure is a rolling wheel, the control unit controls the rolling wheel to roll so as to drive the robot vacuum cleaner 200 to move, and cleaning member can clean the floor during the moving of the robot vacuum cleaner 200.

In an embodiment, the robot vacuum cleaner 200 includes a first communication module, the base includes a second communication module, and the robot vacuum cleaner 200 and the laundry treatment device can communicate with each other through the first communication module and the second communication module. For example, the robot vacuum cleaner 200 can return to the robot vacuum cleaner chamber 1*b* automatically through a wireless communication between the first communication module and the second communication module.

As an example, the first communication module and the second communication module may include, but are not limited to, one or more of following wireless data communication modules: a Bluetooth module, a Wireless Fidelity (WIFI) module, a 4th Generation/5th Generation (4G/5G) communication module, or an infrared module, etc.

In an embodiment, the base includes a controller for controlling the operation of various electronic components of the base, such as the reversing valve 22.

Functions of the laundry treatment machine 100 are not limited. For example, the laundry treatment machine 100 may have a washing function and/or a drying function. In other words, the laundry treatment machine 100 can be a washing machine, a drying machine and/or a washing and drying machine, etc.

In some embodiments, the laundry treatment machine 100 includes a water accommodating barrel. The tub is rotationally arranged within the water accommodating barrel. The tub is provided with water passage holes through which water liquid can flow between the tub and the water accommodating barrel. The tub is configured to place and treat clothes. For example, the tub is configured to wash and/or dry clothes, etc.

A rotation axis of the tub may extend in a vertical direction, in an inclined direction or in a horizontal direction. In other words, the laundry treatment machine 100 can be a pulsator laundry treatment machine 100 or a drum laundry treatment machine 100, etc.

In an embodiment, with reference to FIGS. 2 to 9, the water inlet assembly 2 includes a third switch valve 28 arranged on the primary water inlet path 21. The third switch valve 28 is configured to allow or prevent the entry of the tap water into the primary water inlet path 21. In this way, a water inlet of the primary water inlet path 21 can be controlled by the third switch valve 28 autonomously.

In an embodiment, the third switch valve 28 may have a throttling function. That is, the third switch valve 28 is closed when a flow velocity of the water flowing through the third switch valve 28 is greater than a set value. In this way, an extreme flow velocity of the water from the primary water inlet path 21 is avoided.

The third switch valve 28 is not limited to a specific type. As an example, the third switch valve includes but is not limited to a solenoid valve.

In an embodiment, the laundry treatment machine 100 includes a water injection path in fluid communication with the tub, and the primary water inlet path 21 is in fluid communication with the water injection path. For example, the water injection path is configured to be fluidly connected to the tap water path. The primary water inlet path 21 and the water injection path can share a same tap water faucet, water from which enters into the base and the tub through the primary water inlet path 21 and the water injection path respectively, thus realizing tap water distribution, saving structural members and reducing changes to the tap water path of the user.

In an embodiment, the laundry treatment machine 100 includes a fourth switch valve arranged on the water injection path. The primary water inlet path 21 is connected to a pipe of the water injection path located upstream of the fourth switch valve. The fourth switch valve controls a water inlet of the water injection path into the tub, and the third switch valve 28 controls a water inlet of the primary water inlet path 21, such that a main water inlet of the base and a main water inlet of the tub are independently controlled respectively. For example, a water flow of the washing portion 1*a* can be independently controlled by the third switch valve 28 without being affected by the laundry treatment machine 100, as long as the third switch valve 28 is powered. Thus the third switch valve 28 can operate independently even if the fourth switch valve is not powered and does not work. For example, a water flow of the washing portion 1*a* can be independently controlled by the third switch valve 28 without being affected by the laundry treatment machine 100, as long as the third switch valve 28 is powered. Thus the third switch valve 28 can operate independently even if the fourth switch valve is not powered and does not work.

In an embodiment, with reference to FIG. 1, the base includes a support frame 101 with an arranging chamber in which the pedestal 1 is arranged. The laundry treatment machine 100 can be supported above the support frame 101. The support frame 101 is configured to bear a weight of the laundry treatment machine 100, and the pedestal 1 does not need to bear a heavy weight. Therefore, the pedestal 1 can be made of a lightweight material such as plastic etc., thereby reducing a material cost. The washing portion 1*a* and the support frame 101 are separated from each other through the pedestal 1, so as to prevent water in the washing portion 1*a* from contacting the support frame 101.

A structure form of the washing portion 1*a* is not limited. As an example, in an embodiment, with reference to FIGS. 2 to 9, the washing portion 1*a* presents a groove-like structure with an upper opening. In this way, the washing portion 1*a* can contain clean water from the first water inlet branch 23, and can also contain dirty water produce by washing the cleaning member.

As an example, in an embodiment, the laundry treatment machine 100 includes a casing in which an outer barrel and the tub are accommodated. The casing is located above and connected with the support frame 101. In this way, the casing and the support frame 101 can be manufactured separately, thereby facilitating installations of the tub and the pedestal 1 etc., and reducing manufacturing difficulty.

In other embodiments, the laundry treatment device includes a shell in which the pedestal 1 and the tub are located. That is, the pedestal 1 and the tub share a same shell.

In some embodiments, with reference to FIGS. 2 to 9, the base includes a washing head which is arranged on the first water inlet branch 23 and which can spray water to the washing portion 1*a* or the cleaning member. In this way, the cleaning member can be flushed and washed through the washing head 10, which facilitates a removal of dirt from the cleaning member. The cleaning member can also rotate by itself to contact with the water in the washing portion 1*a* and facilitate the removal of dirt from the cleaning member.

In an embodiment, with reference to FIGS. 2 to 9, the water inlet assembly 2 includes a third water inlet branch 25. The base includes a water discharge assembly 9 including a water discharge path 91 and a water discharge pump 92. The water discharge path 91 fluidly connects the washing portion 1*a* to the outside. The water discharge pump 92 is arranged on the water discharge path 91. A first end of the third water inlet branch 25 is configured to be fluidly connected to the tap water path, and a second end of the third water inlet branch 25 is fluidly connected to a pipe of the water discharge path 91 between the water discharge pump 92 and the washing portion 1*a*.

As an example, each of the third water inlet branch 25 and the water discharge path 91 may be a conduit structure.

The water discharge pump 92 is configured to drive the water in the water discharge path 91 to flow to the outside. The water discharge pump 92 is not limited to a specific type. As an example, the water discharge pump 92 may be an impeller pump.

Here, the water discharge assembly 9 discharges water by means of the Venturi effect. In an embodiment, during discharging water, water flows into the water discharge path 91 through the third water inlet branch 25 and is discharged to the outside, such as a floor drain 1000, through the water discharge pump 92. In this way, air in the water discharge path 91 can be discharged as much as possible. After the air in the water discharge path 91 is substantially exhausted, the liquid in the washing portion 1*a* is automatically sucked into the water discharge path 91, and finally discharged to the outside, such as the floor drain 1000, through the water discharge pump 92. In this way, a liquid discharge of the washing portion 1*a* is achieved.

It should be noted that a water flow from the third water inlet branch 25 can continuously flow into the water discharge path 91 during the whole water discharging process, that is, the water flow from the third water inlet branch 25 together with the liquid within the washing portion 92 are discharged to the outside through the water discharge pump 1*a*. Alternatively, after the air in the water discharge path 91 is substantially exhausted, a water flow path from the third water inlet branch 25 into the water discharge path 91 is blocked. At this time, only the liquid within the washing portion 1*a* is discharged to the outside through the water discharge pump 92 without water flow from the third water inlet branch 25.

Figure 4:
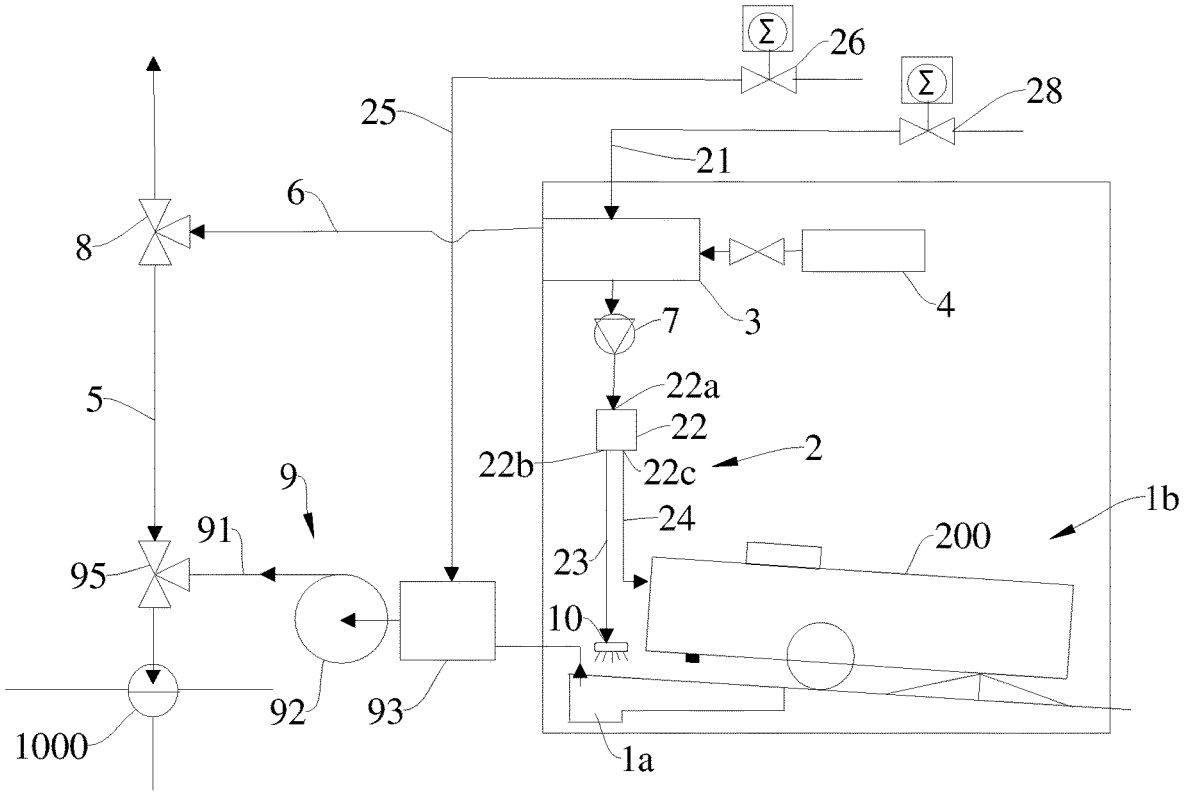
FIG. 4 is a schematic view illustrating the principle of water intake and water discharge of a third type of base in the present disclosure.
Figure 5:
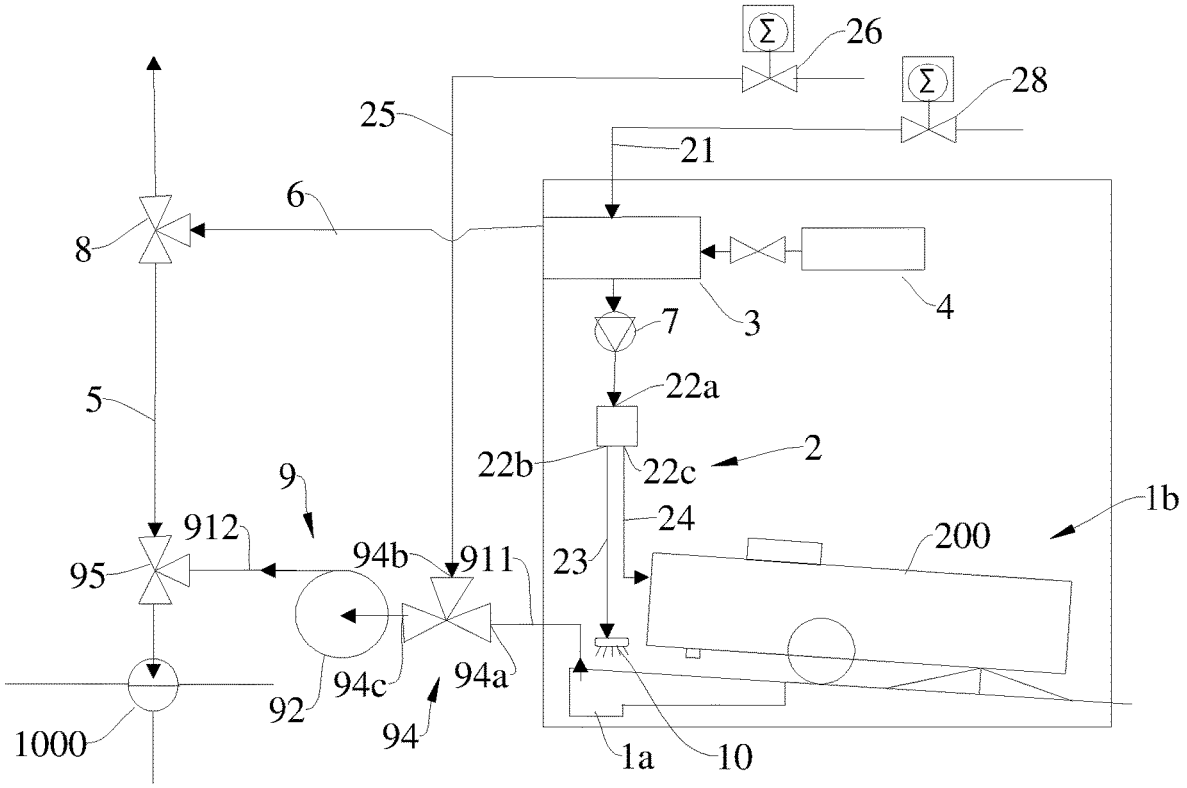
FIG. 5 is a schematic view illustrating the principle of water intake and water discharge of a forth type of base in the present disclosure.
Figure 6:
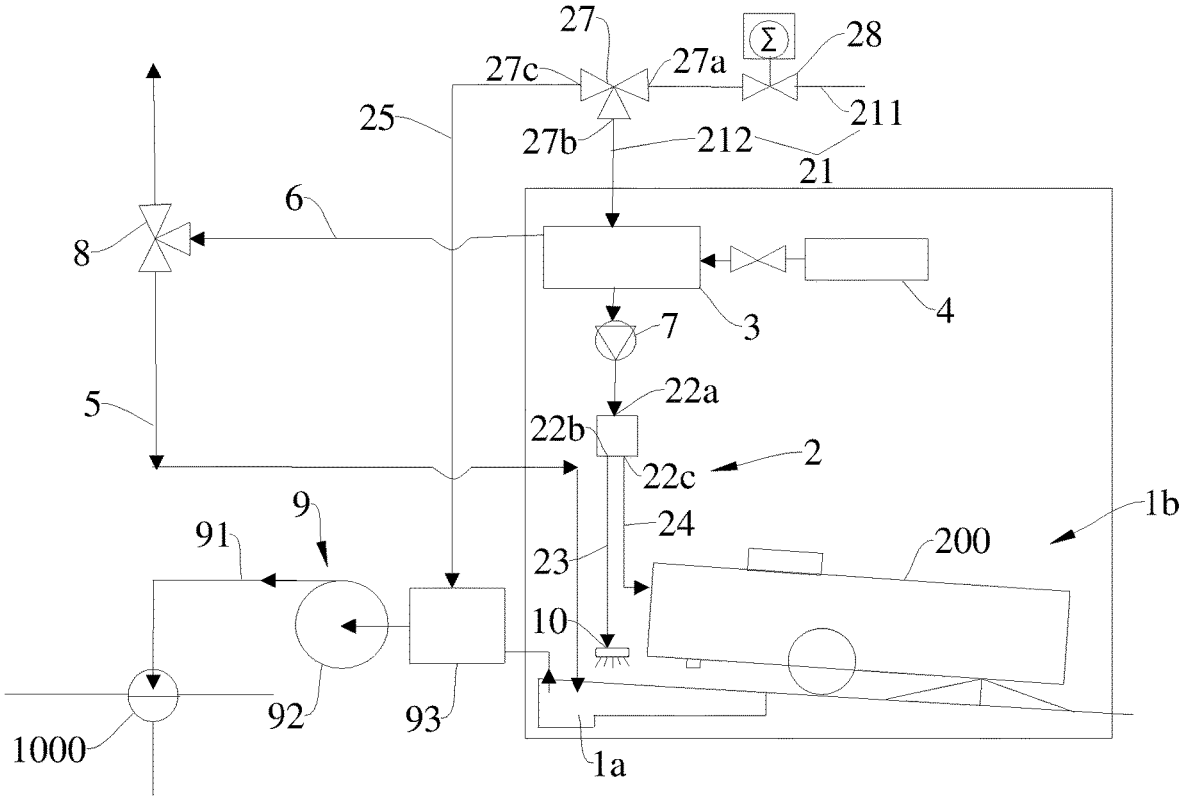
FIG. 6 is a schematic view illustrating the principle of water intake and water discharge of a fifth type of base in the present disclosure.

In an embodiment, with reference to FIGS. 4 and 5, the water inlet assembly 2 includes a second switch valve 26 arranged on the third water inlet branch 25. The second switch valve 26 is configured to allow or prevent the entry of the tap water into the third water inlet branch 25. In this way, the third water inlet branch 25*a* can be independently controlled by the second switch valve 26 to improve a degree of autonomy. As an example, after the air in the water discharge path 91 is substantially exhausted, the water flow path from the third water inlet branch 25 into the water discharge path 91 can be blocked through the second switch valve 26.

In an embodiment, the second switch valve 26 may have a throttling function. That is, the second switch valve 26 is closed when a flow velocity of the water flowing through the second switch valve 26 is greater than a set value. In this way, an extreme flow velocity of the water from the third water inlet branch 25 is avoided.

The second switch valve 26 is not limited to a specific type. As an example, the second switch valve 26 includes but is not limited to a solenoid valve.

In some embodiments, each of the third water inlet branch 25 and the primary water inlet path 21 may be in fluid communication with the tap water path of the user. For example, the third water inlet branch 25 is in fluid communication with the tap water faucet separately, and a tap water flow path of the third water inlet branch 25 may be controlled by the second switch valve 26. The primary water inlet path 21 is in fluid communication with the tap water faucet separately, and a tap water flow path of the primary water inlet path 21 may be controlled by the third switch valve 28.

In some embodiments, with reference to FIGS. 2, 3 and 6 to 9, the water inlet assembly 2 includes a second multi-way connector 27, through which the first end of the third water inlet branch 25 is fluidly connected to the primary water inlet path 21. The second multi-way connector 27 is a multi-way joint or a multi-way valve. As an example, the second multi-way connector 27 is located downstream of the third switch valve 28 in a flow direction of the water in the primary water inlet path 21. Through the second multi-way connector 27, the third water inlet branch 25 can be in fluid communication with the primary water inlet path 21, and tap water can be distributed from the primary water inlet path 21 into the third water inlet branch 25. Thus the third water inlet branch 25 and the primary water inlet path 21 can share a same tap water faucet, for a purpose of reducing the tap water faucets, saving costs and reducing changes to the tap water path of users.

Multi-way joint refers to a connection structure in which each of several ports remains through. For example, in the case of a three-way joint, the three-way joint includes three port, each of which remains in a through state. It can be understood that the multi-way joint is not limited to the three-way joint, but may also be a four-way joint or a five-way joint, etc., which is not listed in extenso herein.

Multi-way valve refers to a connection structure in which each of several valve ports can be opened or closed. For example, in the case of a three-way valve, the three-way valve includes three valve ports, each of which can be opened or closed independently. It can be understood that the multi-way valve is not limited to the three-way valve, but can also be a four-way valve or a five-way valve, etc., which is not listed in extenso herein.

The multi-way valve is not limited to a specific type. As an example, the multi-way valve can be a solenoid valve.

For example, if the second multi-way connector 27 is a multi-way valve, with reference to FIGS. 2, 3 and 6 to 9, the second multi-way connector 27 may include a main water inlet 27*a*, a first distribution port 27*b* and a second distribution port 27*c*. The primary water inlet path 21 includes a main pipe 211 and a branch pipe 212. The main pipe 211 is in fluid communication with the main water inlet 27*a* and the tap water path. The branch pipe 212 is in fluid communication with the first distribution port 27*b* and the valve inlet 22*a*. The third water inlet branch 25 is in fluid communication with the second distribution port 27*c*. Each of the main water inlet 27*a*, the first distribution port 27*b* and the second distribution port 27*c* may be opened or closed independently.

As an example, when a water discharge is required, the main water inlet 27*a* and the second distribution port 27*c* may be opened, the first distribution port 27*b* may be closed, and the water discharge pump 92 remains in operation, such that the tap water enters into the water discharge path 91 through the third water inlet branch 25, so as to discharge water through the negative pressure. When it is necessary to supplement water to the liquid container of the robot vacuum cleaner 200, the main water inlet 27*a*, the first distribution port 27*b* and the second valve outlet 22*c* may be opened, and the second distribution port 27*c* and the first valve outlet 22*b* may be closed, such that the tap water enters into the liquid container so as to supplement water into the liquid container. The base can also add water to the washing portion 1*a* separately, or add water both to the washing portion 1*a* and the liquid container at the same time. Those skilled in the art can know realizations of above specific functions according to the example disclosed in the present disclosure, which are not described in extenso herein.

It should be noted that "several" means a quantity including two or more. The second multi-way connector 27 may be a multi-way joint or a multi-way valve. A number of interfaces of the multi-way joint and a number of ports of the multi-way valve may be selected according to requirements, which are not described herein.

In some embodiments, with reference to FIGS. 2, 4, 6, 8 and 9, the water discharge assembly 9 includes a water storing chamber 93 disposed on the water discharge path 91. The water storing chamber 93 is located upstream of the water discharge pump 92 in a flow direction of water in water discharge path 91. The second end of the third water inlet branch 25 is fluidly connected to the water storing chamber 93. The water from the third water inlet branch 25 may be temporarily stored in the water storing chamber 93. The water storing chamber 93 is configured to store water. During water discharging, water can be injected into the water storing chamber 93 through the third water inlet branch 25, and the water discharge pump 92 pumps the water in the water storing chamber 93 to form a negative pressure the water discharge path 91. Therefore, it is possible to pump the liquid in the washing portion 1*a*, discharge water automatically, and improve a convenience of the water discharging of the base.

Figure 3:
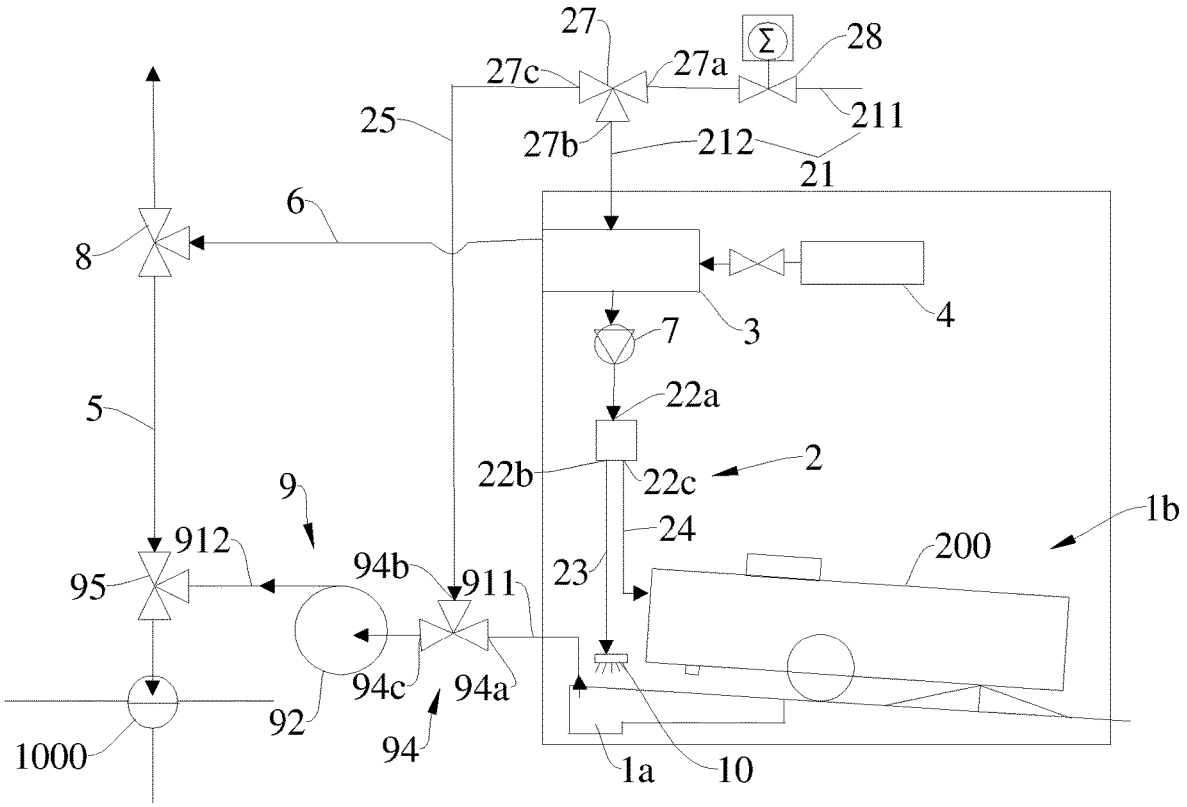
FIG. 3 is a schematic view illustrating the principle of water intake and water discharge of a second type of base in the present disclosure.
Figure 7:
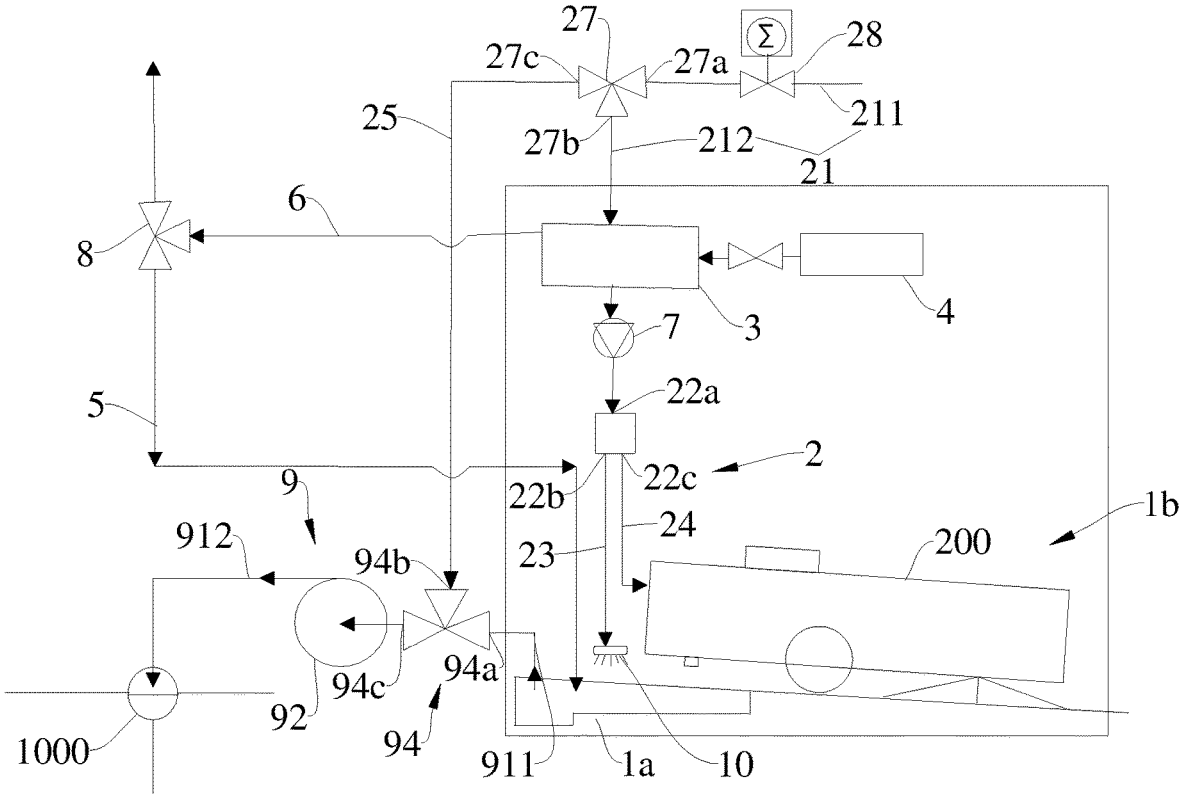
FIG. 7 is a schematic view illustrating the principle of water intake and water discharge of a sixth type of base in the present disclosure.

In some embodiments, with reference to FIGS. 3, 5 and 7, the water discharge assembly 9 includes a third multi-way connector 94, which is located upstream of the water discharge pump 92 in the flow direction of the water in the water discharge path 91. The second end of the third water inlet branch 25 is fluidly connected to the water discharge path 91 through the third multi-way connector 94, which is a multi-way joint or a multi-way valve.

Herein, each of the third water inlet branch 25 and the water discharge path 91 may be a conduit structure. The third multi-way connector 94 serves to communicate with the third water inlet branch 25, the water discharge path 91 and the water discharge pump 92. The water in the third water inlet branch 25 can be delivered into the water discharge branch through the third multi-way connector 94, so as to exhaust the air in the water discharge path 91, thus the water discharge pump 92 can pump the liquid in the washing portion 1*a* through the negative pressure.

As an example, with reference to FIGS. 3, 5 and 7, the water discharge path 91 includes a first water discharge sub-pipe 911 and a second water discharge sub-pipe 912. The third multi-way connector 94 includes a first water inlet 94*a*, a second water inlet 94*b* and a water outlet 94*c*. The first water discharge sub-pipe 911 is in fluid communication with the washing portion 1*a* and the first water inlet 94*a*. The second end of the third water inlet branch 25 is fluidly connected to the second water inlet 94*b*. A inlet of the water discharge pump 92 is in fluid communication with the water outlet 94*c*. The second water discharge sub-pipe 912 is in fluid communication with an outlet of the water discharge pump 92 and the outside, such as the floor drain 1000. A portion of the first water discharge sub-pipe 911 is higher than a highest height of the washing portion 1*a*, and at least a portion of the first water discharge sub-pipe 911 extends upwards. In this way, the water discharge pump 92 pumps the water in the water storing chamber 93 such that a negative pressure is formed within the first water discharge sub-pipe 911, and the siphon effect can be generated between the water storing chamber 93 and the washing portion 1*a* such that the liquid in the washing portion 1*a* is pumped and discharged to the outside.

In the case that the third multi-way connector 94 is a multi-way joint, the third water inlet branch 25, the inlet of the water discharge pump 92 and the first water discharge sub-pipe 911 remain in a through state. In the case that the third multi-way connector 94 is a multi-way valve, water flow paths of above three structures can remain through or be blocked according to requirements. For example, when the water discharge assembly 9 is in a water discharge state, the first water inlet 94*a*, the second water inlet 94*b* and the water outlet 94*c* of the third multi-way connector 94 are fluidly connected to each other. When the water discharge assembly 9 is not operated, each of the first water inlet 94*a*, the second water inlet 94*b* and the water outlet 94*c* of the third multi-way connector 94 can be closed.

In an embodiment, with reference to FIGS. 2 to 9, the base includes a liquid storage chamber 3 which is arranged on the primary water inlet path 21 and located upstream of the valve inlet 22*a* in a flow direction of water in the primary water inlet path 21. That is, the water in the primary water inlet path 21 firstly flows through the liquid storage chamber 3, and then flows through the reversing valve 22. The liquid storage chamber 3 serves to relieve pressure and slow flow, such that the water flows at a suitable flow velocity to avoid an excessive water pressure in the primary water inlet path 21.

In an embodiment, with reference to FIGS. 2 to 9, the base includes a detergent container 4 in fluid communication with the liquid storage chamber 3. The detergent container 4 serves to accommodating detergent. As an example, the detergent container 4 is located in the arranging chamber and above the pedestal 1. The detergent container 4 is able to add detergent to the liquid storage chamber 3. The detergent enters into the washing portion 1*a* with water to better treat the cleaning member.

The detergent includes but is not limited to fluid such as washing agent and/or fragrance.

An appearance of the detergent container is not limited. For example, the detergent container may present a cylindrical-shaped or conical-shaped bottle structure. The detergent container can present a polyhedral case structure, such as a hexahedral case structure.

In some embodiments, the detergent container 4 may be a disposable means. After the detergent in the detergent container 4 is used up, the detergent container 4 can be taken out and replaced with a new detergent container 4. In other embodiments, the user may inject detergent into the detergent container 4, thus the detergent container 4 may be reused, which saves energy and protects environment.

In an embodiment, the base includes a feeding pump for pumping the detergent in the detergent container 4 into the liquid storage chamber 3. As an example, the feeding pump may be disposed in the arranging chamber and above the pedestal 1. The detergent is pumped through the feeding pump to realize an independent, quantitative and accurate feed of the detergent, thus improving automation.

In an embodiment, the base includes a controller which can be configured to achieve an electrical control of various electronic components of the base, such as the reversing valve 22, the third switch valve 28, and the feeding pump. As an example, the controller may be located in the arranging chamber and arranged above the pedestal 1. On the one hand, various electronic components of the base can be controlled independently and not affected by electronic components of the laundry treatment machine 100, as long as the controller is connected to the power supply. Thus the various electronic components of the base can work independently, even if the electronic components of the laundry treatment machine 100 are not powered and do not work. On the other hand, the controller is arranged above the pedestal 1, such that a space above the pedestal 1 can be fully utilized.

In an embodiment, with reference to FIGS. 2 to 9, the base includes an overflow path 5 in fluid communication with the liquid storage chamber 3. Liquid in the liquid storage chamber 3 is discharged to the outside or into the washing portion 1*a* through the overflow path 5 responsive to a water level of the liquid storage chamber 3 higher than a predetermined water level. In this way, the water level in the liquid storage chamber 3 can be limited below the predetermined water level, so as to avoid an excessive water quantity and an excessive water pressure in the liquid storage chamber 3 leading to a risk of pipe explosion. For example, the water from the overflow path 5 may be discharged to the outside such as the floor drain 1000. In this way, overflowing water is directly discharged to a sewer through the floor drain 1000. For another example, water from the overflow path 5 can also be discharged into the washing portion 1*a*, for a purpose of avoiding water waste.

It should be noted that the outside refers to an external environment for the base. As an example, the outside may be the floor drain 1000 outside the base.

In an embodiment, with reference to FIGS. 2 to 9, the base includes a ventilation path 6 and a first switch valve 7. The ventilation path 6 fluidly connects the liquid storage chamber 3 to the atmosphere, the first switch valve 7 is arranged on the primary water inlet path 21, and the first switch valve 7 is located between the liquid storage chamber 3 and the valve inlet 22*a*. The first switch valve 7 is configured to control a flow of water from the liquid storage chamber 3. On the one hand, when the first switch valve 7 is closed, the liquid in the liquid storage chamber 3 would not flow out, thus the detergent and water in the liquid storage chamber 3 can be mixed at first and then discharged together, so as to better dilute the detergent. On the other hand, the ventilation path 6 is configured to keep an air pressure balance in the liquid storage chamber 3. For example, when the first switch valve 7 is not operated, the liquid storage chamber 3 is in fluid communication with the atmosphere through the ventilation path 6, thus water from the primary water inlet path 21 can still enter into the liquid storage chamber 3 successfully.

As an example, the first switch valve 7 includes but is not limited to a solenoid valve.

Figure 8:
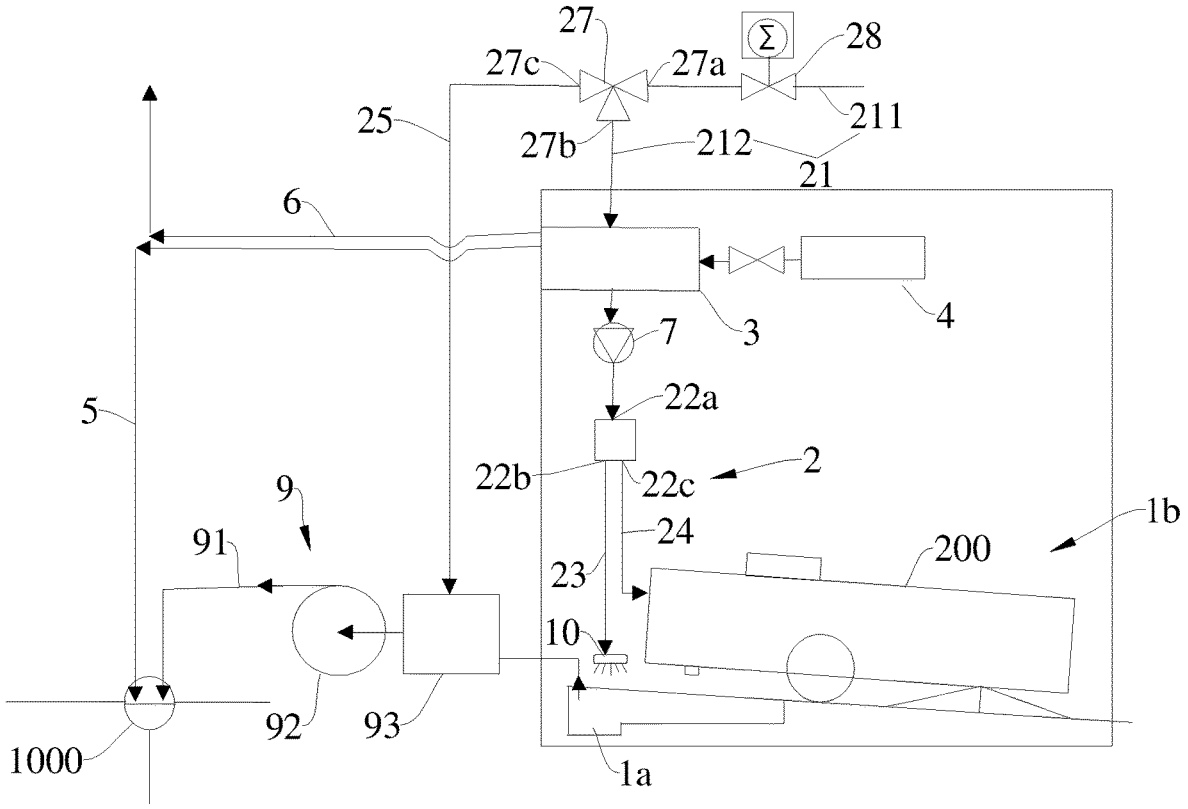
FIG. 8 is a schematic view illustrating the principle of water intake and water discharge of a seventh type of base in the present disclosure.
Figure 9:
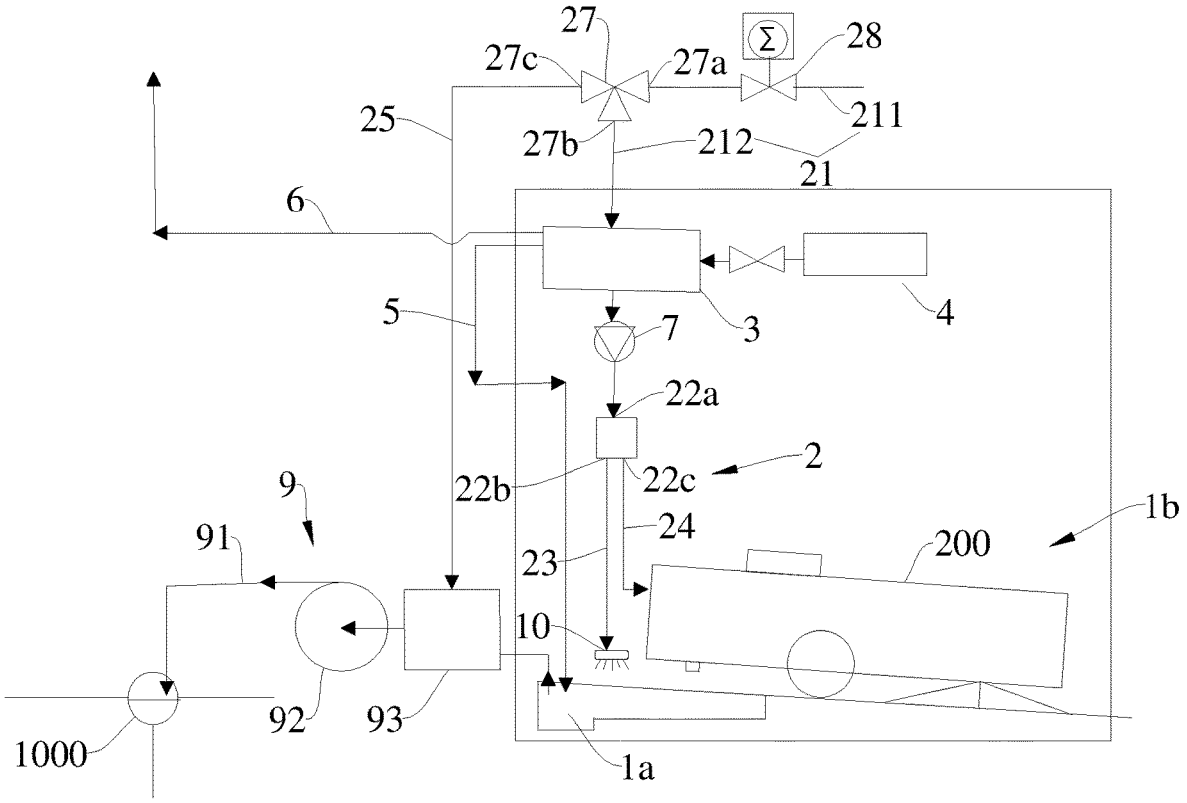
FIG. 9 is a schematic view illustrating the principle of water intake and water discharge of an eighth type of base in the present disclosure.

In some embodiments, with reference to FIGS. 8 and 9, the ventilation path 6 and the overflow path 5 may be separate pipes from each other. As an example, the liquid storage chamber 3 is provided with two through holes, each of which is in fluid communication with corresponding one of the ventilation path 6 and the overflow path 5, such that the ventilation path 6 and the overflow path 5 would not interfere with each other.

In an embodiment, with reference to FIGS. 2 to 7, the base includes the overflow path 5 in fluid communication with the liquid storage chamber 3. A first end of the overflow path 5 is fluidly connected to the ventilation path 6, and a second end of the overflow path 5 is fluidly connected to the outside or the washing portion 1*a*. That is, the overflow path 5 and the ventilation path 6 can share a part of a pipe. In this way, not only the pipes can be saved and a layout of the pipes can be simplified, but also openings on the liquid storage chamber 3 can be reduced. For example, the liquid storage chamber 3 can be provided with a communication opening at a set height of the liquid storage chamber 3, which is in fluid communication with the ventilation path 6. Thus, when the water level in the liquid storage chamber 3 reaches a position where the communication opening is located, water can enter into the overflow path 5 through the communication opening.

As an example, the communication opening may be provided on a top surface or a peripheral side surface or the like of the liquid storage chamber 3.

In an embodiment, with reference to FIGS. 2 to 7, the base includes a first multi-way connector 8, through which the first end of the overflow path 5 is fluidly connected to the ventilation path 6. The first multi-way connector 8 is a multi-way joint or a multi-way valve. Each of the ventilation path 6 and the overflow path 5 can be a conduit structure. The overflow path 5 can be in fluid communication with the ventilation path 6 though the first multi-way connector 8. Thus the overflow path 5 and the ventilation path 6 can share a part of the pipe.

The first multi-way connector 8 is a multi-way joint, thus the ventilation path 6 and the overflow path 5 remain a through state all the time. Alternatively, the first multi-way connector 8 is a multi-way valve, such that the ventilation path 6 and the overflow path 5 can remain through or be blocked selectively according to requirements.

In an embodiment, with reference to FIGS. 2 to 9, a highest point of the overflow path 5 is not higher than a lowest point of the ventilation path 6. That is, the highest point of the overflow path 5 is flush with or lower than the lowest point of the ventilation path 6. Thus the liquid in the overflow path 5 is prevented from entering into the ventilation path 6.

In some embodiments, with reference to FIGS. 2 to 5, the base includes the overflow path 5 and the liquid storage chamber 3 which is arranged on the primary water inlet path 21. The overflow path 5 is in fluid communication with the liquid storage chamber 3 located upstream of the valve inlet 22*a* in the flow direction of water in the primary water inlet path 21. The water discharge assembly 9 includes a fourth multi-way connector 95, which is arranged on the water discharge path 91 and located downstream of the water discharge pump 92 in the flow direction of the water in the water discharge path 91. The overflow path 5 is in fluid communication with the water discharge path 91 through the fourth multi-way connector 95, which is a multi-way joint or a multi-way valve. The fourth multi-way connector 95 serves to be fluidly connected to the overflow path 5, the water discharge path 91 and the outside, such that the overflow path 5 and the water discharge path 91 can share the same floor drain 1000, and there is no need to provide different floor drains 1000 for the overflow path 5 and the water discharge path 91 respectively, thus saving structural members.

The fourth multi-way connector 95 is a multi-way joint, thus the overflow path 5, the water discharge path 91 and the outside remain a through state all the time. Alternatively, the fourth multi-way connector 95 is a multi-way valve, such that the overflow path 5 and the water discharge path 91 can remain through or be blocked selectively according to requirements.

In some embodiments, the laundry treatment machine 100 is provided with a sewage discharge path which is in fluid communication with the water accommodating barrel and is configured to discharge liquid within the water accommodating barrel to the outside of the laundry treatment machine 100. In an embodiment, the water discharge path 91 can be in fluid communication with the sewage discharge path, that is, the base can achieve water discharge through the sewage discharge path of the laundry treatment machine 100. For example, the water discharge path 91 can be fluidly connected to the sewage discharge path directly. Alternatively, in another implementation, the water discharge pump 92 may be fluidly connected to the sewage discharge path directly, that is, the water discharge path 91 can be fluidly connected to the sewage discharge path indirectly via the water discharge pump 92. In this way, the water discharge path 91 and sewage discharge path can share the same floor drain 1000.

After the washing of the cleaning member is accomplished, the liquid within the washing portion 1*a* can flow into the sewage discharge path through the water discharge path 91, and then be discharged to the outside of the laundry treatment device through the sewage discharge path, so as to improve a convenience of water discharge.

In some implementations, the liquid within the water accommodating barrel can also flow into the water discharge path 91 through the sewage discharge path, and then be discharged to the outside of the laundry treatment machine 100 through the water discharge path 91. That is, the laundry treatment machine 100 can achieve water discharge through the water discharge path 91 of the base. Alternatively, the water discharge path 91 can be arranged independently. That is, each of the water discharge path 91 and the sewage discharge path independently discharges water into a corresponding floor drain 1000 respectively.

Embodiments of the present disclosure further provide a cleaning system. With reference to FIG. 1, the cleaning system includes the robot vacuum cleaner 200 and the laundry treatment device according to any embodiment of the present disclosure. The robot vacuum cleaner 200 is provided with the cleaning member and is movable into and out of the robot vacuum cleaner chamber 1*b*.

According to the cleaning system in the embodiments of the present disclosure, the laundry treatment machine 100 can be configured to treat laundry, such as wash the laundry. The robot vacuum cleaner 200 can be configured to clean floor. The pedestal 1 provides an accommodation space for the robot vacuum cleaner 200, which no longer needs to occupy extra floor area, so as to save spaces and provide better user experience.

The base can be further configured to provide charging function and/or drying function and the like for the robot vacuum cleaner 200.

In an embodiment, the base includes a charging terminal and a power assembly electrically connected with the charging terminal. The charging terminal is arranged on a peripheral side of the pedestal 1, and the power assembly is located above the pedestal 1. When the robot vacuum cleaner 200 is located within the robot vacuum cleaner chamber 1*b*, the robot vacuum cleaner 200 can be electrically connected with the charging terminal in order to be charged. The power assembly is configured to convert AC current of commercial power into DC current, and the charging terminal charges the robot vacuum cleaner 200 with DC current.

Specific positions of the detergent container 4, the power assembly and the third switch valve 28 etc. in the arranging chamber are not limited. As an example, in an embodiment, the detergent container 4 and the power assembly are disposed at intervals in a left-right direction, and the third switch valve 28 is located behind the detergent container 4. A rear side of the support frame 101 is usually close to a wall, and the detergent container 4 is close to a front side, such that the user can pick up and arrange the detergent container 4 from the front side of the support frame 101. The third switch valve 28 is located behind the detergent container 4 to facilitate a connection between the third switch valve 28 and the tap water path on the wall, shortening a pipe between the third switch valve 28 and the tap water path.

In an embodiment, the laundry treatment device may further include a drying air duct and a fan arranged on the pedestal 1. The drying air duct is in fluid communication with the fan and the robot vacuum cleaner chamber 1*b*. The fan ventilates the robot vacuum cleaner chamber 1*b* through the drying air duct to quickly dry the cleaning member of the robot vacuum cleaner 200.

Above description is merely specific implementations of the present disclosure, but the protection scope of the present disclosure is not limited to above description. Any change or substitution conceivable for those skilled in the art within the technology scope of the present disclosure should be covered within the protection scope of the present disclosure. Therefore, the protection scope of the present disclosure should be defined by the claims.

The invention claimed is:

1. A base comprising:

a pedestal comprising a chamber for a robot vacuum cleaner and a washing portion configured to wash a cleaning member of the robot vacuum cleaner;

a water inlet assembly comprising a primary water inlet path, a liquid storage chamber arranged on the primary water inlet path, a first switch valve arranged on the primary water inlet path and located downstream of the liquid storage chamber, and a ventilation path fluidly connecting the liquid storage chamber to an atmosphere, wherein the water inlet assembly further comprises at least one of a first water inlet branch in fluid communication with the primary water inlet path, and a second water inlet branch in fluid communication with the primary water inlet path, the primary water inlet path being configured to be fluidly connected to a tap water path, the first water inlet branch being in fluid communication with the washing portion, the second water inlet branch being configured to be fluidly connected to a liquid container of the robot vacuum cleaner.

2. The base according to claim 1, wherein the water inlet assembly comprises a reversing valve comprising a valve inlet, a first valve outlet and a second valve outlet, the primary water inlet path being in fluid communication with the valve inlet, the first water inlet branch being in fluid communication with the first valve outlet and the washing portion, the second water inlet branch being configured to fluidly connect the second valve outlet to the liquid container.

3. The base according to claim 2, wherein the liquid storage chamber is located upstream of the valve inlet in a flow direction of the water in the primary water inlet path.

4. The base according to claim 3, further comprising a detergent container in fluid communication with the liquid storage chamber.

5. The base according to claim 3, further comprising an overflow path in fluid communication with the liquid storage chamber, and liquid in the liquid storage chamber is discharged to an outside or discharged into the washing portion through the overflow path responsive to a water level of the liquid storage chamber higher than a predetermined water level.

6. The base according to claim 3, wherein the first switch valve is located between the liquid storage chamber and the valve inlet.

7. The base according to claim 6, further comprising an overflow path, a first end of the overflow path being fluidly connected to the ventilation path, and a second end of the overflow path is being fluidly connected to an outside or the washing portion.

8. The base according to claim 7, further comprising a first multi-way connector, the first end of the overflow path being fluidly connected to the ventilation path through the first multi-way connector, the first multi-way connector being in the form of a multi-way joint or a multi-way valve.

9. The base according to claim 7, wherein a highest point of the overflow path is not higher than a lowest point of the ventilation path.

10. The base according to claim 2, wherein the water inlet assembly comprises a third switch valve arranged on the primary water inlet path, the third switch valve being configured to allow or prevent entry of tap water into the primary water inlet path.

11. The base according to claim 1, wherein the water inlet assembly comprises a third water inlet branch, the base further comprising a water discharge assembly comprising a water discharge path and a water discharge pump, the water discharge path fluidly connects the washing portion to an outside, the water discharge pump is arranged on the water discharge path, a first end of the third water inlet branch is configured to be fluidly connected to the tap water path, and a second end of the third water inlet branch is configured to be fluidly connected to a pipe of the water discharge path located between the water discharge pump and the washing portion.

12. The base according to claim 11, wherein the water inlet assembly comprises a second switch valve arranged on the third water inlet branch, the second switch valve being configured to allow or prevent entry of tap water into the third water inlet branch.

13. The base according to claim 11, wherein the water inlet assembly comprises a second multi-way connector, the first end of the third water inlet branch being fluidly to the primary water inlet path through the second multi-way connector, the second multi-way connector being a multi-way joint or a multi-way valve.

14. The base according to claim 11, wherein the water discharge assembly comprises a water storing chamber arranged on the water discharge path and located upstream of the water discharge pump in a flow direction of the water in the water discharge path, the second end of the third water inlet branch being fluidly connected to the water storing chamber.

15. The base according to claim 11, wherein the water discharge assembly comprises a third multi-way connector located upstream of the water discharge pump in a flow direction of water in the water discharge path, and the second end of the third water inlet branch is in fluid communication with the water discharge path through the third multi-way connector in the form of a multi-way joint or a multi-way valve.

16. The base according to claim 11, further comprising an overflow path and a liquid storage chamber arranged on the primary water inlet path, the overflow path being in fluid communication with the liquid storage chamber, the water discharge assembly comprising a fourth multi-way connector arranged on the water discharge path and located downstream of the water discharge pump in a flow direction of water in the water discharge path, the overflow path being in fluid communication with the water discharge path through the fourth multi-way connector in the form of a multi-way joint or a multi-way valve.

17. The base according to claim 11, wherein the water inlet assembly comprises a third switch valve arranged on the primary water inlet path, the third switch valve being configured to allow or prevent entry of tap water into the primary water inlet path.

18. The base according to claim 1, wherein the water inlet assembly comprises a third switch valve arranged on the primary water inlet path, the third switch valve being configured to allow or prevent entry of tap water into the primary water inlet path.

19. A laundry treatment device comprising:

a laundry treatment machine comprising a tub; and a base comprising:

a pedestal comprising a chamber for a robot vacuum cleaner and a washing portion configured to wash a cleaning member of the robot vacuum cleaner;

a water inlet assembly comprising a primary water inlet path, a liquid storage chamber arranged on the primary water inlet path, a first switch valve arranged on the primary water inlet path and located downstream of the liquid storage chamber, and a ventilation path fluidly connecting the liquid storage chamber to an atmosphere, wherein the water inlet assembly further comprises at least one of a first water inlet branch in fluid communication with the primary water inlet path, and a second water inlet branch in fluid communication with the primary water inlet path, the primary water inlet path being configured to be fluidly connected to a tap water path, the first water inlet branch being in fluid communication with the washing portion, the second water inlet branch being configured to be fluidly connected to a liquid container of the robot vacuum cleaner, and wherein the pedestal is arranged below the tub.

20. A cleaning system comprising:

a robot vacuum cleaner; and a laundry treatment device comprising:

a laundry treatment machine comprising a tub; and a base comprising:

a pedestal comprising a chamber for the robot vacuum cleaner and a washing portion configured to wash a cleaning member of the robot vacuum cleaner;

a water inlet assembly comprising a primary water inlet path, a liquid storage chamber arranged on the primary water inlet path, a first switch valve arranged on the primary water inlet path and located downstream of the liquid storage chamber, and a ventilation path fluidly connecting the liquid storage chamber to an atmosphere, wherein the water inlet assembly further comprises at least one of a first water inlet branch in fluid communication with the primary water inlet path, and a second water inlet branch in fluid communication with the primary water inlet path, the primary water inlet path being configured to be fluidly connected to a tap water path, the first water inlet branch being in fluid communication with the washing portion, the second water inlet branch being configured to be fluidly connected to a liquid container of the robot vacuum cleaner, wherein the pedestal is arranged below the tub; and wherein the robot vacuum cleaner is movable into and out of the chamber.

* * * * *